United States Patent [19]

Shindo et al.

[11] Patent Number: 4,976,369

[45] Date of Patent: Dec. 11, 1990

[54] CONTAINER

[75] Inventors: Nobuaki Shindo, Tokyo; Seiji Naruse, Kimitsu; Fumiaki Maeda, Kashiwa; Yuujirou Miyamoto, Chiba; Toshio Takeuchi, Funabashi, all of Japan

[73] Assignee: Lion Corporation, Tokyo, Japan

[21] Appl. No.: 271,042

[22] Filed: Nov. 14, 1988

[30] Foreign Application Priority Data

Nov. 13, 1987 [JP] Japan ..... 62-173680

[51] Int. Cl.[5] ..... B65D 17/34; B65D 25/32

[52] U.S. Cl. ..... 220/270; 220/91; 220/276; 229/2.5 R

[58] Field of Search ..... 220/270, 276, 91; 229/2.5 R

[56] References Cited

U.S. PATENT DOCUMENTS

| | | | |
|---|---|---|---|
| 3,119,540 | 1/1964 | Schenk | 229/2.5 R |
| 3,275,184 | 9/1966 | Henderson | 220/270 |
| 3,347,407 | 10/1967 | Coolidge | 220/270 |
| 3,436,008 | 4/1969 | Sanangelo | 229/2.5 R |
| 3,557,998 | 1/1941 | Collie | 220/270 |
| 4,039,099 | 8/1977 | Boxall | 220/91 |
| 4,103,803 | 8/1978 | Iruine | 220/270 |
| 4,399,926 | 8/1983 | Eidels-Dubouoy | 220/91 |
| 4,669,630 | 6/1987 | Kenyon | 220/276 |
| 4,790,448 | 12/1988 | Ostrum | 220/276 |

FOREIGN PATENT DOCUMENTS

| | | | |
|---|---|---|---|
| 1465848 | 12/1966 | France | 220/270 |
| 2086361 | 5/1982 | United Kingdom | 220/270 |

*Primary Examiner*—George E. Lowrance
*Attorney, Agent, or Firm*—Darby & Darby

[57] ABSTRACT

A container used for selling powders such as a washing powder and the like comprises a main body for filling the powders therein and a lid member for covering an upper opening of the main body. A band member is disposed through a score at a peripheral edge of the lid member except at a part of the peripheral edge thereof and has a peeling-off projection formed at its end. A picking-up projection is disposed at a wall of the lid member just above a space where no band member is defined. Each of these projections has a rectangular shape and has opposite surfaces. The surfaces of the peeling-off and picking-up projection are at approximately right angles to each other. These projections serve to protect one another from impacts or shocks exerted on one another. As the result, these projections are prevented them from deformation. Therefore, the container gives confidence that it can be opened by the impacts or the shocks exerted thereon at ease. After it has been opened, the fact can be confirmed because it cna hardly be opened without peeling off the band member.

At least a pair of rivets is preferably formed at upper portions of pillars of a frame member of the main body because the pillars have a mechanical strength enough to hold out against a force exerted through the handle member on the rivets.

7 Claims, 4 Drawing Sheets

CONTAINER

BACKGROUND OF THE INVENTION

1. Field of the Invention

The present invention relates to a container for filling powders such as a washing powder and the like therein.

2. Prior Art

FIG. 9 shows a typical example of conventional containers. The container comprises a main body 1 including a bottom portion (not shown) having a rectangular shape, a pair of first end walls 1*a* disposed at longitudinal edges of the bottom portion at an approximately right angle to the bottom portion and a pair of second end walls 1*b* disposed at transverse edges of the bottom portion at an approximately right angle to the bottom portion, an arched-shaped handle member 2 including a pair of side bars 2*a* and a central bar 2*b* for connecting between ends of the side bars 2*a* and a lid member 3 for covering marginal portions of the four end walls 1*a* and 1*b* of the main body 1 and an opening (not shown) defined by edges of the four end walls. A top and four side walls of the lid member 3 have a plain surface. Linear apertures 2*c* having opposite ends are formed at opposite ends of the side bars 2*a* of the handle member 2, each linear aperture 2*c* extending in a longitudinal direction towards the handle member 2. Rivets 4 are disposed at central upper portions of the first end walls 1*a* of the main body 1 by means of a riveting machine. The handle member 2 is rotatably disposed on the first end walls by engaging the rivets 4 with the linear apertures 2*c* so as to rotate the handle member 2 about an image line defined between both of the rivets 4. The handle member 2 is laid down so that an inner surface of the central bar 2*b* thereof is contact with an outer surface of the second end wall 1*b* of the main body 1 before it is used or when the handle member 2 is not used. Conversely, the handle member 2 is raised up in order to lift the container up when it is used. When the container is lifted up by the handle member 2, one end of the linear aperture 2 facing to the end of the side bar 2*a* of the handle member 2 is engaged with the rivet 4. A space defined between the handle member 2 raised up and the top of the lid member 3 is determined in accordance with a distance between the opposite ends of the linear aperture 2*c*.

Also, such a container has a seal 5 for confirming whether or not it has been opened. As shown in FIG. 9, the seal 5 is put on both the outer surfaces of the second end wall 1*b* of the main body 1 and the side wall of the lid member 3 so that the container is sealed it. Therefore, the container cannot be opened without peeling off the seal 5.

A thus-described conventional container however, has faults which include:

(1) The seal 5 gives no confidence as to whether the container has been opened or not because the container can be put under the seal 5 by sticking it again thereon.

(2) Also, it is difficult for the lid member 3 to be taken off the main body 1 because the lid member 3 has a plain surface and because no means for lifting up the lid member 3 is included on the lid member 3. In particular, when the fingers of a user are wet e.g. by washing, the user cannot easily open the container.

In order to obviate such defects as above-described, the present inventors have formulated at container which further comprises a picking-up projection formed outward on the outer surface of the side wall of the lid member 3, a peripheral projection formed outward peripherally on an upper portion of the outer surfaces of the end walls 1*a* or 1*b* of the main body 1 and a band member disposed through a score at edges of the side walls of the lid member 3 and having a groove formed at an inner surface thereof. The groove of the band member is engaged with the peripheral projection of the main body 1 and thereby the lid member 3 can be accurately put on the main body 1. Also, the score has a thickness less than that of the remainder of the lid member 3 and has a mechanical strength such that it will not fail to tear when the band member is peeled off. Therefore, the container cannot be opened without peeling off the band member. Further, the lid member 3 can be easily taken off from the main body 1 by picking up the projection thereof.

However, the present inventors have further found that the improved container has drawbacks. Namely, the projection of the lid member 3 is at risk of coming into hard contact with handle members of another containers when the containers are stacked and wholly packaged in order to transport to markets or stores. When the picking-up projection of the lid member 3 is subjected to shock in this way, the lid member 3 is forced away from the main body 1 and the washing powder in the container is exposed.

Also, the band member may peel off when one end of the band member is snagged on the corner of another container or on the handle members 2. In these cases, each container is substantially accidentally opened.

SUMMARY OF THE INVENTION

Accordingly, it is an object of the present invention to provide a container which can be easily opened when required, and, in addition, which inspires confidence that it has not been opened prior to this and which cannot be opened by accident.

Accordingly, in the present invention, there is provided a container comprising a main body including a bottom portion, at least one end wall disposed at a peripheral edge of the bottom portion and a peripheral projection disposed outward peripherally on outer surfaces of the end wall, a lid member including a central portion, a peripheral wall disposed at a peripheral edge of the central portion and a picking-up projection formed outward on the peripheral wall and extended in a peripheral direction thereof, a band member disposed through a score at a peripheral edge of the peripheral wall of the lid member and having a peripheral groove formed at an inner surface thereof for engaging with the peripheral projection when said main body is covered with the lid member and a peeling-off projection formed on at least one of opposite ends of the band member and extended in a transverse direction thereof, the picking-up and peeling-off projections formed at a near position having the approximately identical height and being at approximately right angles to each other.

BRIEF DESCRIPTION OF THE DRAWINGS

The present invention will now be described with reference to the accompanying drawings wherein.

DESCRIPTION OF PREFERRED EMBODIMENTS OF THE INVENTION

Figure 1:
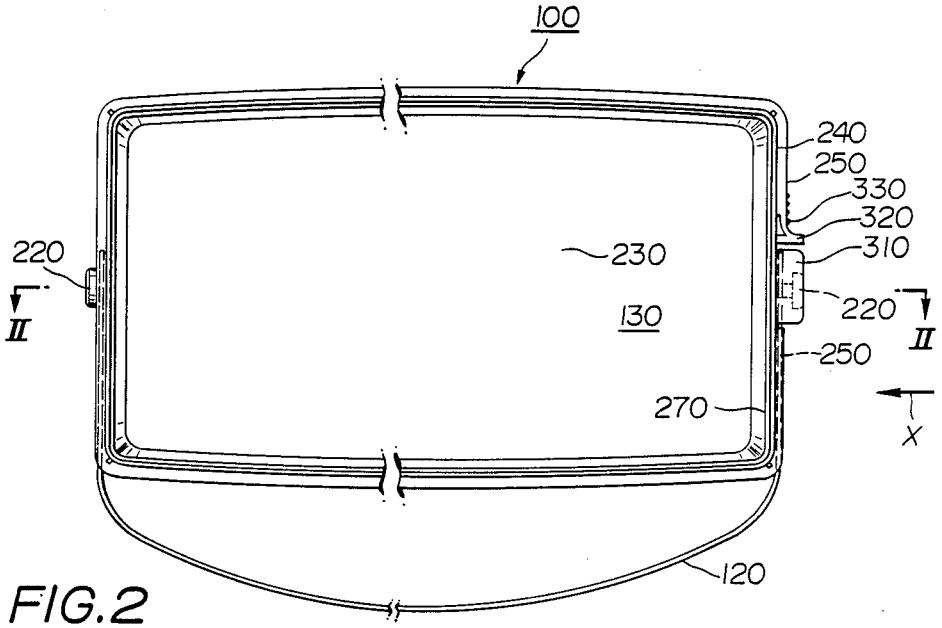
FIG. 1 is a diagrammatic plan view showing a preferred embodiment of the present invention.

FIGS. 1 to 7 illustrate a container of the present invention represented by reference numeral 100. The container 100 comprises a main body 110 having an approximately rectangular parallelepiped shape and having a rectangular shaped opening 111 at an upper portion thereof, a handle member 120 for lifting the container 100 up and a lid member 130 for covering the opening 111 and the upper portion of the main body 110.

The main body 110, called the pillar-carton, comprises a blank sheet 140 for constructing four end walls and four side corners of the main body 110 and a frame member 150 for preventing the main body 110 from deformation.

Figure 5:
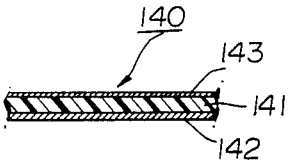
FIG. 5 is a sectional view taken along the plane V—V of FIG. 4.
Figure 4:
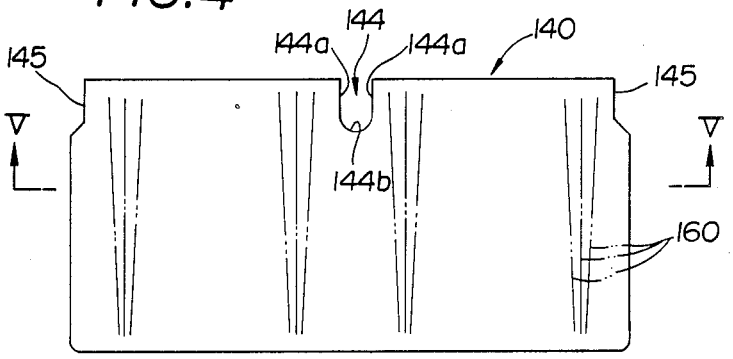
FIG. 4 is a diagrammatic plan view showing a sheet suitable used as an assembly of the preferred embodiment of the present invention.

As shown in FIGS. 4 and 5, the blank sheet 140 has an approximately rectangular shape and comprises a main sheet 141 made of paper materials, a film 142 made of synthetic resins superimposed on one surface of the main sheet 141 and a coating layer 143 of varnishes formed on the other surface of the main sheet 141. An advertisement can be printed on the film 142 of the blank sheet 140. A first notch 144 is formed at a central portion of a longitudinal marginal portion of the blank sheet 140 and comprises a pair of opposite edges **144*a* each extending in a transverse direction along sheet 140 and an arched edge 144*b* defined between the opposite edges 144*a*. Also, a pair of second notches 145 are formed at a pair of corners defined at ends of the longitudinal marginal portion having the first notch 144, respectively. Each of the second notches 145 has the identical plan-view geometries as a half of the first notch 144 which is taken along an image line defined in the transverse direction of the blank sheet 140 with passing through a central point of the arched edge 144*b*. A machine direction of the main sheet 141 of the blank sheet 140 substantially parallels a direction of ridgelines defined by side corners of the main body 110. The length of the longitudinal edges of the blank sheet 140 are determined on the basis of the peripheral length of the frame member 150. Also, the length of the transverse edges of the blank sheet 140 are determined on the basis of the height of the frame member 150. Four bundles of lines 160 at which the sheet 140 can be easily bent when each of the side corners of the main body 110 is formed are disposed at portions of one surface of the sheet 140 in accordance with the side corners to be formed, each of the lines 160 extending approximately in the machine direction of the sheet 140, i.e., in the transverse direction thereof. A bundle of the lines 160 include three lines in this embodiment. Intervals among the three lines 160 are continuously reduced as the lines 160** close toward the longitudinal edge having no notches.

Figure 2:
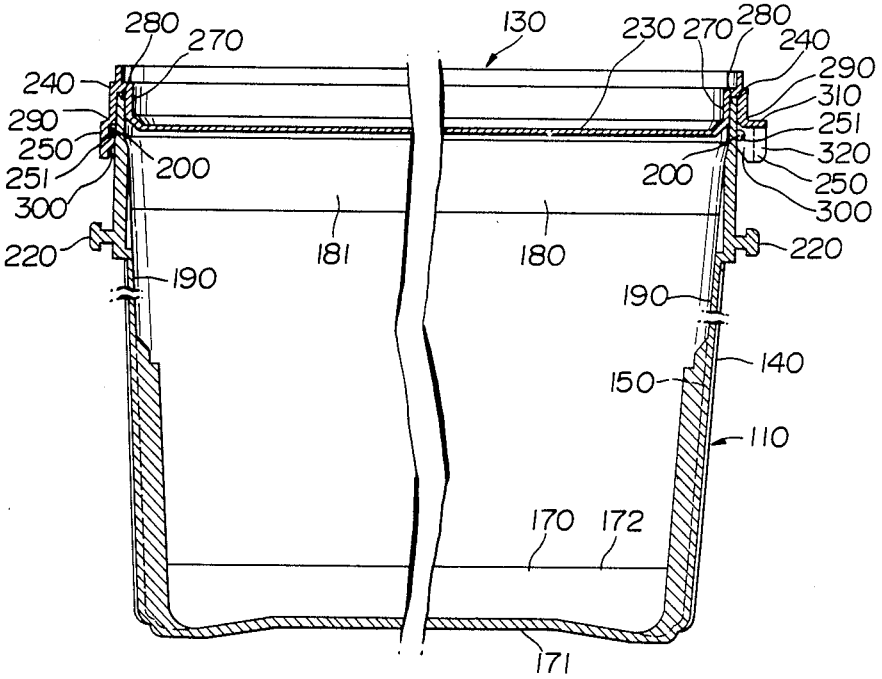
FIG. 2 is a sectional view taken along the plane II—II of FIG. 1 showing the preferred embodiment of the present invention.
Figure 3:
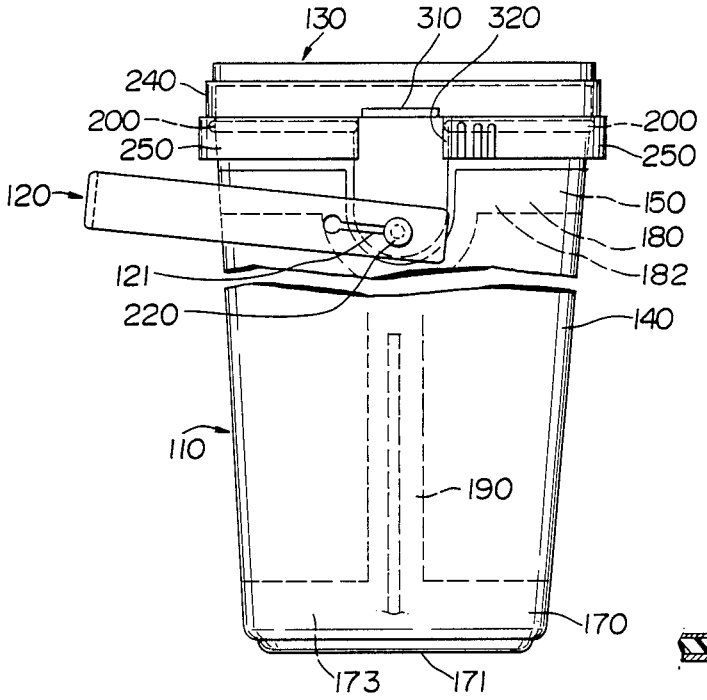
FIG. 3 is a view in the direction of the arrow X in FIG. 1.

The frame member 150 comprises a rectangular tray shaped lower portion 170 including a bottom portion 171 having a rectangular shape, a pair of first side walls 172 of low height disposed at longitudinal edges of the bottom portion 171 and a pair of second side walls 173 of low height disposed at transverse edges thereof, a rectangular frame shaped upper portion 180 including a pair of longitudinal end walls 181 and a pair of transverse end walls 182 and a pair of pillars 190 for connecting central portions of the second side walls 173 of the lower portion 170 with central portions of the transverse end walls 182 of the upper portion 180 so as to be assembled the upper portion 180 just above the lower portion 170 at a predetermined interval as shown in FIGS. 2 and 3. In the frame member 150, a plan-view geometry of the bottom portion 171 of the lower portion 170 is not greater than that of the upper portion 180.

With respect to the upper portion 180 of the frame member 150, a pair of peripheral projections 200 having semicircular cross-sections are formed outward peripherally on outer surfaces of the longitudinal and transverse end walls 181 and 182 of the upper portion 180 except on two central portions of the transverse end walls 182. In the central portions of the transverse end walls 182, opposite ends of the peripheral projections 200 face each other at a predetermined interval.

A pair of rivets 220 used for putting a handle member 120 to the main body 110 are disposed at upper portions of the pillars 190 of the frame member 150, respectively. Each of the rivets 220 has an approximately T-shaped cross-section and has a circular plate formed at a top portion thereof. Such rivets 220 may be formed on the main body 110 in one step of an injection molding for manufacturing the main body 110. In this way, the main body 110 can be easily and efficiently manufactured because a riveting machine is not required.

The frame member 150 is surrounded with the blank sheet 140 so as to cover a space defined by the lower and upper portions 170 and 180 and the pillars 190 therewith to thereby be assembled into the main body 110. Specifically, a pair of transverse marginal portions of the coating layer 143 of the blank sheet 140 are pasted up on one of the pillars 190 so that the marginal portions face each other and a pair of longitudinal marginal portions of the coating layer 143 are peripherally pasted up on the first and second side walls 172 and 173 of the lower portion 170 and on the longitudinal and transverse end walls 181 and 182 of the upper portion 180, respectively. The first notch 144 and a pair of the second notches 145 of the blank sheet 140 serve to avoid the rivets 220 disposed on the upper portions of the pillars 190 of the frame member 150 when the blank sheet 140 is pasted up on the side portion of the frame member 150.

The blank sheet 140 may be pasted up on the side portion of the frame member 150 while the frame member 150 is molded by the injection molding. In this case, the blank sheet 140 is put in a mold which can be separated into a male and female sections, i.e., with a space defined between the male and female sections and then materials used for making the frame member 150 are injected into the space. Immediately after the injection, the materials are subjected to a molding pressure to be molded thereby to the frame member 150 with the blank sheet 140, that is, to obtain the main body 110. This process has the advantage of manufacturing the main body 110 simply.

The lid member 130 comprises a central portion 230 having the approximately identical plan-view geometries as the opening 111 of the main body 110, an inner peripheral wall 270 disposed upward at a peripheral edge of the central portion 230 so as to be at an approximately right angle to an outer surface of the central portion 230, a skirt portion 240 disposed downward and outward at an upper peripheral portion of the inner peripheral wall 270 and a band member 250 having opposite ends and disposed through a score 290 at a peripheral edge of the skirt portion 240 except at a central portion of one of the transverse portions of the skirt portion 240 where the opposite ends or a starting and finishing ends thereof face each other at a predetermined interval.

As shown in FIG. 2, a peripheral groove 280 is defined between the skirt portion 240 and the inner peripheral wall 270. When the opening 111 of the main body 110 is covered with the lid member 130, the peripheral groove 280 is engaged with the upper peripheral edge of the main body 110. Also, the score 290 has a thickness less than that of the skirt portion 240 or that of the band member 250. Therefore, the band member 250 can be easily peeled off along the score 290. Also, an inner peripheral groove 251 having an approximately U-shaped cross-section is formed at an inner peripheral surface of the band member 250. The inner peripheral groove 251 is a portion for engaging with the peripheral projections 200 of the main body 110 when the opening 111 of the main body 110 is covered with the lid member 130. A tapered surface 300 facing to inward and downward is formed at a lower peripheral portion of the inner peripheral surface of the band member 250. When the inner peripheral groove 251 of the band member 250 is engaged with the peripheral projections 200 of the main body 110, the tapered surface 300 serves to smoothly guide the peripheral projections 200 to the inner peripheral groove 251. Thus, when the main body 110 is covered with the lid member 130, the tapered surface 300 of the lid member 130 is brought into contact with the peripheral projections 200 of the main body 110 and is subjected to a force which is exerted upward and outward thereon in accordance with such contact. As the result, the lower peripheral portion of the band member 250 of soft and resilient synthetic resins is spread outward to thereby engage the inner peripheral groove 251 with the peripheral projections 200. Also, one of the rivets 220 of the main body 110 is positioned beneath a space defined between the starting and finishing ends of the band member 250 while the main body 110 is covered with the lid member 130.

A peeling-off projection 320 having a rectangular shape and having opposite surfaces is disposed outward through a connecting portion 330 at the starting end of the band member 250 and is at approximately right angle to the surface of the skirt portion 240 of the lid member 130. Each of the opposite surfaces of the peeling-off projection 320 faces to a longitudinal direction of the band member 250. Also, an inner surface of the peeling-off projection 320 is secured to the surface of the skirt portion 240. The connecting portion 330 has a thickness less than that of the band member 250. An inner surface of the connecting portion 330 parts from the surface of the skirt portion 240. With the band member 250, it can be peeled off by lifting the peeling-off projection 320 upwards.

A picking-up projection 310 having a rectangular shape and having opposite surfaces is disposed outward at the surface of the central transverse portion of the skirt portion 240 above the peeling-off projection 320 and is at an approximately right angle to the surface of the skirt portion 240 and the peeling-off projection 320. A length of the picking-up projection 310 in the peripheral direction of the band member 250 is shorter than the distance between the starting and finishing ends thereof. Also, the picking-up and peeling-off projections 310 and 320 and the rivets 220 have the approximately indentical height. Therefore, top surfaces of these projections 310, 320 and the rivets 220 can be included one image plane. Further, a pair of corners of the picking-up projection 310 directed away from the surface of the lid member 130 are made round or tapered because the corners serve to rotate smoothly the handle member 120 rotatably connected to the rivets 220. The corners do not hinder raising up the handle member 120 or laying down it when it is operated.

Figure 7:
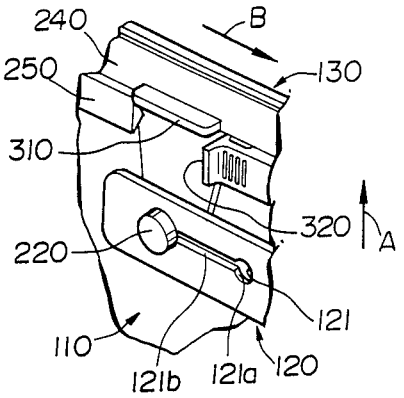
FIG. 7 is a view similar to FIG. 6 but showing the preferred embodiment in a deferent direction from that of FIG. 6.

The picking-up projection 310 serves to protect the peeling-off projection 320 from impacts or shocks exerted on the container 100 in the peripheral direction of the lid member 130 or in a direction of peeling off the band member 250 denoted by the arrow B as shown in FIG. 7. Namely, the picking-up projection 310 has the approximately identical height as the peeling-off projection 320. Also, the projection 310 is disposed in front of the projection 320. Therefore, if the picking-up projection 310 is subjected to such shocks as above described, it will protect the peeling-off projection 320 therefrom. As the result, it is unlikely that the band member 250 could peel off by accident.

Equally, the peeling-off projection 320 serves to protect the picking-up projection 310 from shocks exerted on the container 100 in a direction of the arrow A as shown in FIG. 7. In this case, the peeling-off projection 320 is disposed in front of the picking-up projection 310. Therefore, the picking-up projection 310 is resistant to shocks and, as a result, the lid member 130 is unlikely to part from the main body 110 unintentionally. Meanwhile, the rivet 220 formed at the main body 110 beneath the picking-up projection 310 serves to protect the projection 310 from shocks facing to the projection 310.

Figure 6:
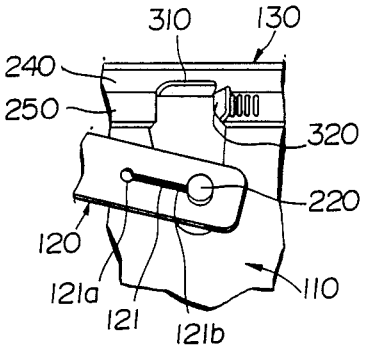
FIG. 6 is a partially cutaway view in perspective of the preferred embodiment of the present invention.

With respect to such container 100, opposite ends of the handle member 120 of flexible materials are rotatably connected to the rivets 220 formed at the main body 110. As shown in FIGS. 3, 6 and 7, the handle member 120 has a pair of linear apertures 121 formed at the opposite ends which extend in longitudinal directions thereof. Each of the linear apertures 121 comprises a pair of arched edges **121*a* and a pair of linear edges 121*b* paralleled to each other and defined between the arched edges 121*a*. An interval between the linear edges 121*b* is determined on the basis of a diameter of a root portion of the rivet 220 so as to pass smoothly it therebetween. An inner diameter of each arched edge 121*a* is determined on the basis of an outer diameter of the circular plate of the rivet 220 so as not to pass it therethrough. A process for connecting the handle member 250 to the rivets 220 formed at the main body 110 includes a step of spreading out the linear aperture 121 in a transverse direction of the linear aperture 121 and a step of inserting the rivet 220 into the linear aperture 121** spread out.

It should be noted that, although the peeling-off projection 320 is formed at only one of the opposite ends of the band member 250, it may be formed at the other end or at the opposite ends thereof. In particular, on the occasion that a pair of the peeling-off projections 320 are formed at the opposite ends of the band member 250, the picking-up projection 310 can be further certainly protected from the shocks by the peeling-off projections 320 and the peeling-off projections 320 can be guarded each other.

Figure 8:
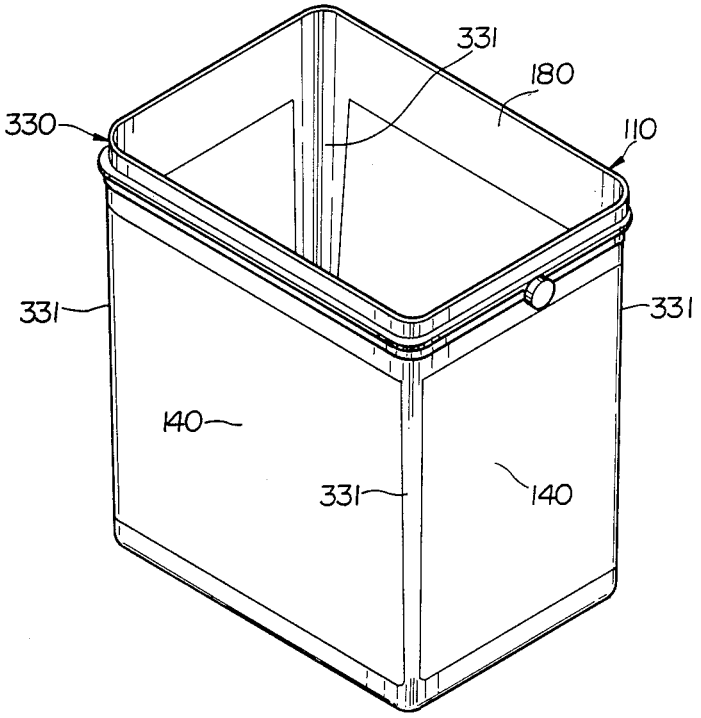
FIG. 8 is a perspective view showing a frame member of another preferred embodiment of the present invention.
Figure 9:
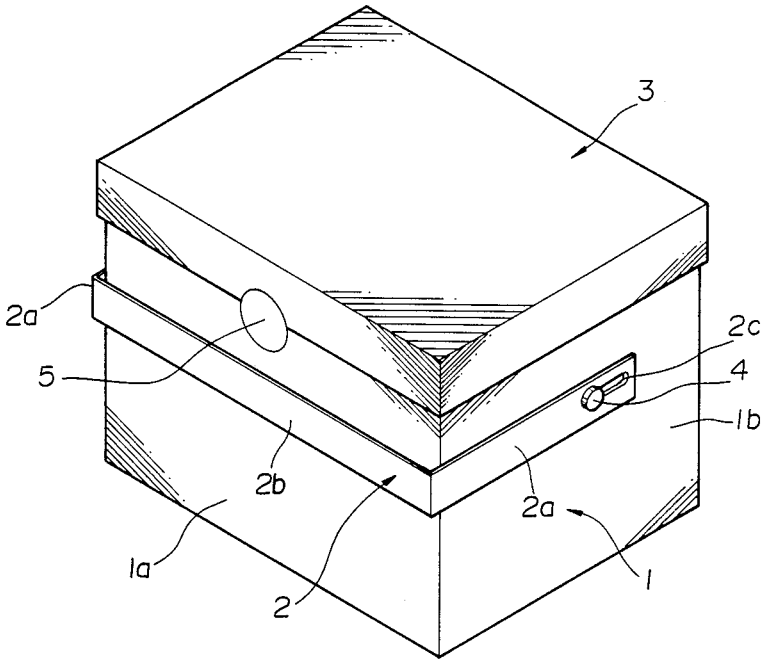
FIG. 9 (PRIOR ART)
FIG. 9 is a perspective view showing a conventional container.

FIG. 8 shows a frame member of another embodiment of the present invention. In this embodiment, the frame member 330 has four pillars 331 for constructing four side corners of the main body 110 and for connecting four side corners of the lower portion 170 with those of the upper portion 180. The container including the frame member 330 has an advantage of using not only the longitudinal side walls of the main body 100 but also the transverse side walls thereof as a space for advertisement.

What is claimed is:

1. A container comprising:

a main body including a bottom portion;

at least one end wall disposed at an outer edge of said bottom portion and a peripheral projection disposed outward peripherally on the outer surface of said end wall;

a lid member including a central portion;

a peripheral wall disposed at an outer edge of said central portion and a picking-up projection formed outward on said peripheral wall and oriented in an outward direction thereof;

a band member disposed through a score at an outer edge of said peripheral wall of said lid member and having a peripheral groove formed at an inner surface thereof, said groove for engaging with said peripheral projection of said lid member when said main body is covered with said lid member; and a peeling off projection formed on at least one of opposite ends of said band member and extended in a transverse direction thereof, said picking up and peeling off projections formed at a position near each other having the approximately identical height and being at approximately right angles to each other.

2. A container according to claim 1, wherein said main body comprises a frame member including a lower portion having a bottom portion, an upper portion having an opening at a center thereof and at least two of pillars for connecting said upper portion with said lower portion at a predetermined interval, and a blank sheet covering a space defined by said upper and lower portions and said pillars.

3. A container according to claim 2, wherein said main body further comprises at least one pair of rivets for connecting said main body with a handle member used for carrying said main body.

4. A container according to claim 3, wherein said picking-up projection is disposed at a portion just above one of said rivets.

5. A container according to claim 3, wherein said rivets are formed together with said main body in one step of an injection molding.

6. A container according to claim 3, wherein said rivets are disposed on upper portions of said pillars, respectively.

7. A container according to claim 5, wherein said blank sheet is fixedly secured to said frame member during said injection molding.

* * * * *